United States Patent [19]

Poulsen

[11] Patent Number: 5,071,384

[45] Date of Patent: Dec. 10, 1991

[54] STEERING MECHANISM

[75] Inventor: Ole V. Poulsen, Vejle, Denmark

[73] Assignee: Interlego AG, Switzerland

[21] Appl. No.: 476,391

[22] PCT Filed: Dec. 1, 1988

[86] PCT No.: PCT/DK88/00200

§ 371 Date: May 31, 1990

§ 102(e) Date: May 31, 1990

[87] PCT Pub. No.: WO89/05179

PCT Pub. Date: Jun. 15, 1989

[30] Foreign Application Priority Data

Dec. 2, 1987 [DK] Denmark ..... 6324/87

[51] Int. Cl.[5] ..... A63H 33/12; A63H 17/36; F16H 29/20

[52] U.S. Cl. ..... 446/103; 74/498; 74/89.18; 446/468; 446/128

[58] Field of Search ..... 446/103, 88, 95, 468, 446/460, 128, 470, 471, 469, 465; 74/498, 422, 89.17, 89.18, 457, 424.6, 89.12, 89.19

[56] References Cited

U.S. PATENT DOCUMENTS

| | | | |
|---|---|---|---|
| 2,651,882 | 9/1953 | Core | 446/451 |
| 3,822,606 | 7/1974 | Yoshino | 74/422 |
| 4,270,397 | 6/1981 | Adams | 74/422 |
| 4,314,710 | 2/1982 | Kamoshita | 74/498 |
| 4,573,372 | 3/1986 | Abe | 74/422 |

FOREIGN PATENT DOCUMENTS

| | | | |
|---|---|---|---|
| 908354 | 4/1954 | Fed. Rep. of Germany . | |
| 2723907 | 11/1978 | Fed. Rep. of Germany . | |
| 2909557 | 9/1980 | Fed. Rep. of Germany . | |
| 3035611 | 2/1984 | Fed. Rep. of Germany . | |
| 470479 | 8/1937 | United Kingdom | 446/460 |

*Primary Examiner*—Danton D. DeMille

*Attorney, Agent, or Firm*—Kane, Dalsimer, Sullivan, Kurucz, Levy, Eisele and Richard

[57] ABSTRACT

A steering mechanism for toy building sets, such as toy vehicles, and of the type comprising a rack means and a pinion cooperating with it. In connection with various possible positions of the rack means and likewise with a view to selective positioning of the pinion cooperating with it, the toothed region of the rack means is provided wholly or partly around the longitudinal axis of the rack means, the rack means being integral with a pair of steering rods which are provided with coupling means.

5 Claims, 3 Drawing Sheets

STEERING MECHANISM

Figure 1:
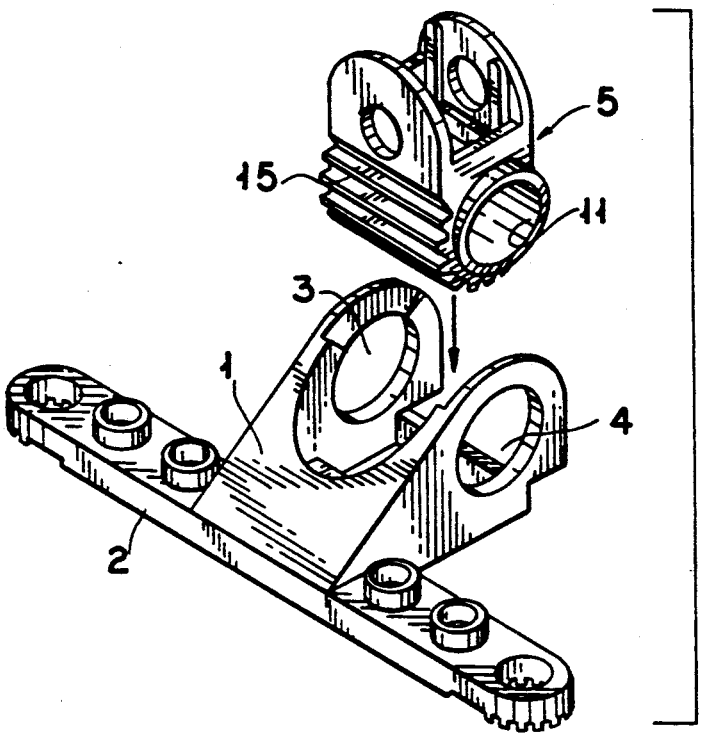

The invention concerns a steering mechanism for toy building sets, such as toy vehicles, and of the type comprising a rack means and a pinion adapted to cooperate with it.

The German Patent Specification 3 035 611 discloses a steering device of said type which comprises a linear rack means with a plane toothed face adapted to cooperate with a gear wheel oriented perpendicularly with respect to said face.

The U.S. Pat. No. 2,651,882 discloses another steering device which is directly based on the principle of a non-linear rack means for cooperation with a pinion. This structure includes a bridge structure which is rotatably suspended and on which an arc-shaped rack means is secured, said rack means engaging a steering wheel controlled pinion. The engagement face of the rack is here disposed in a vertical plane in which the arc shape likewise extends.

It will be appreciated that the mentioned mutual position of rack and pinion is essential to proper tooth engagement, which means that a structure like the one mentioned above is not particularly suitable in connection with alternative structures of a toy model or as a component for incorporation in other model variants.

Further, the German Offenlegungsschrift 2 909 557 discloses a steering structure involving components for a building set that can be interconnected in various ways; however, the possibilities of the mutual positions of rack and pinion are nevertheless limited since the rack is often placed in a horizontal plane and with a horizontally projecting, arc-shaped toothing. The flexibility of these components is thus also limited.

The object of the invention is to provide a steering mechanism which has a very compact structure, which is at the same time very flexible in that it may be used in various, mutual positions of the constituent parts and in connection with incorporation in other toy models.

This object is achieved by providing a steering mechanism as stated in the characterizing portion of claim 1. When a rack means is constructed integrally with steering rod means, the steering gear may be incorporated in various model variants, since the assembled steering rod may be rotated about its longitudinal axis so that the coupling means may be mounted in an arbitrarily disposed plane, and without it being necessary to consider the orientation of the toothing and thus the engagement with the pinion adapted to reciprocate the rack means.

By the steering rods forming an acute angle with the longitudinal axis of the rack means, as stated in claim 2, it is achieved that the ends of the steering rods perform a movement which is not only rotatory but also translatory, when the rack means is rotated about its own axis.

To improve the flexibility additionally, the bearing bushing may be rotatable as mentioned in claim 3 so that the pinion may slide transversely to the rack. Then the steering gear may be adapted to various requirements and needs for the individual toy model and variants of it.

This is feasible because the toothing is provided over such a great extent that it satisfies the requirement with respect to the various possible positions of the steering rod means and their coupling means, while the toothing area is sufficient to accomodate various steering wheel inclinations. When, as stated in claim 4, a corrugation is provided externally on the bushing means, the steering column may assume various inclinations, the corrugation being caused to cooperate with a flexible engagement means.

Figure 2:
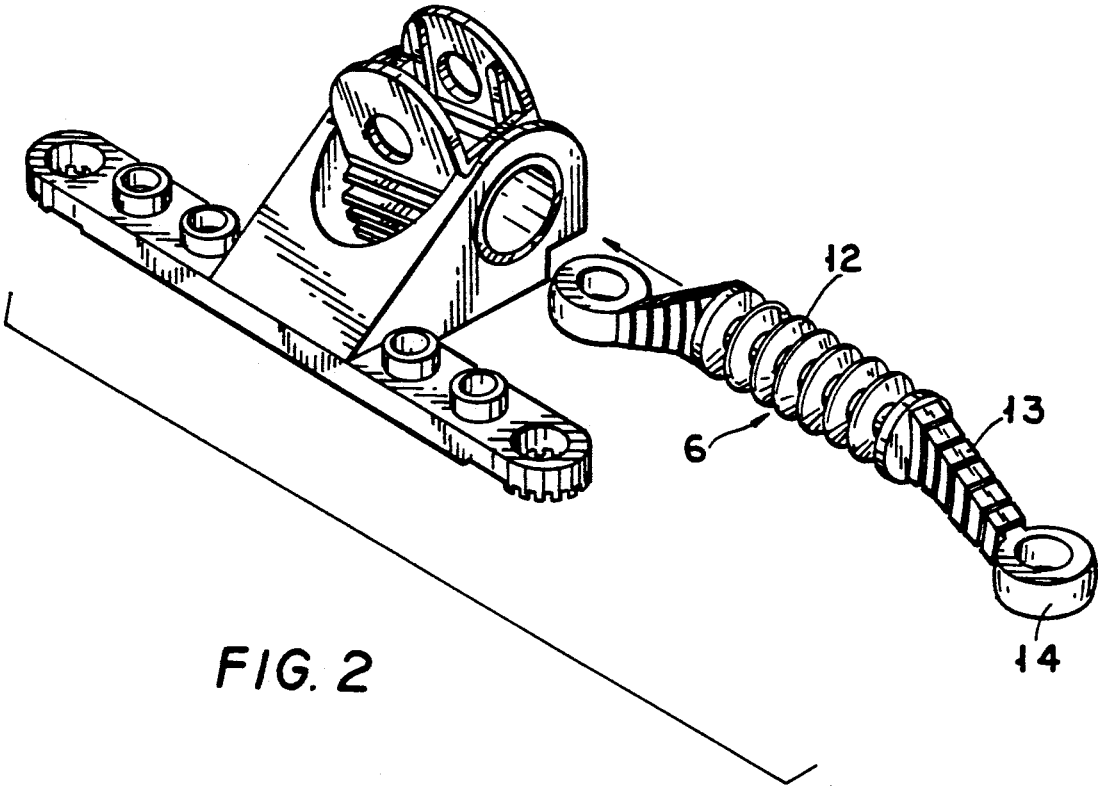
Figure 3:
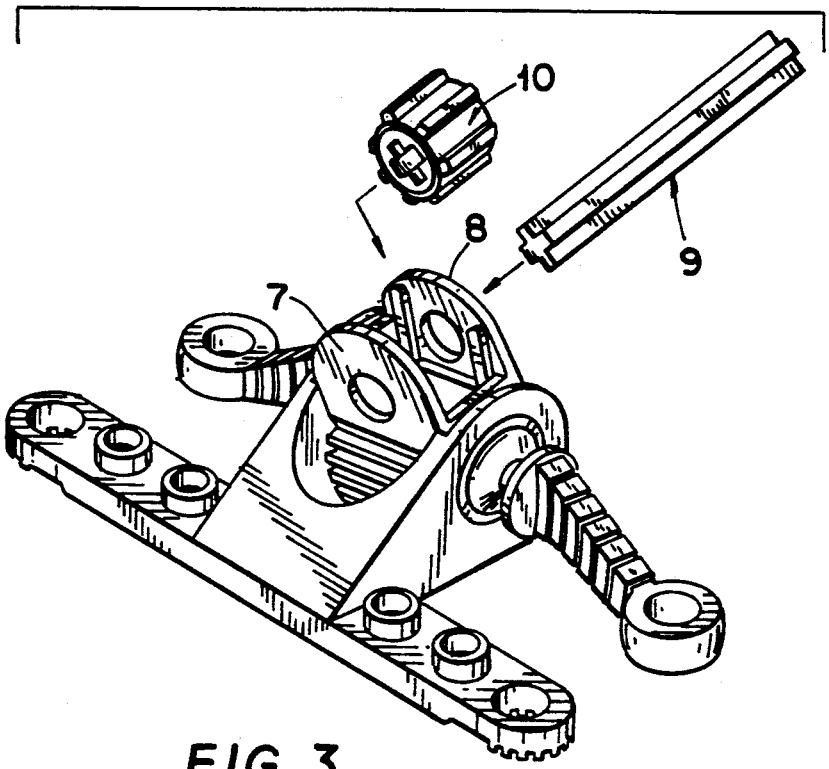
Figure 4:
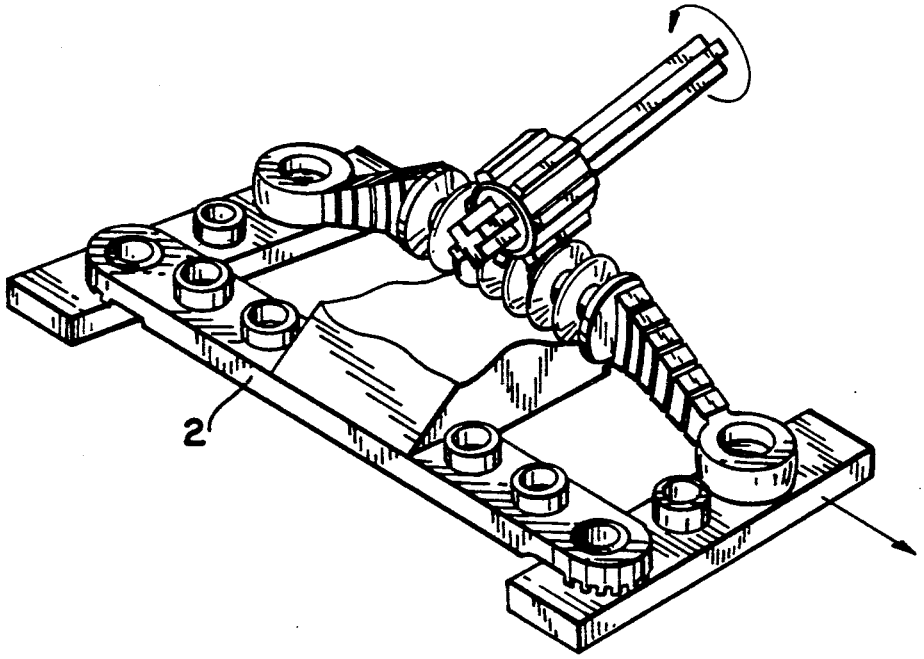
Figure 5:
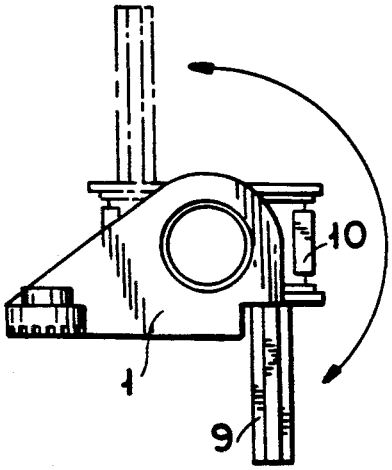
Figure 6:
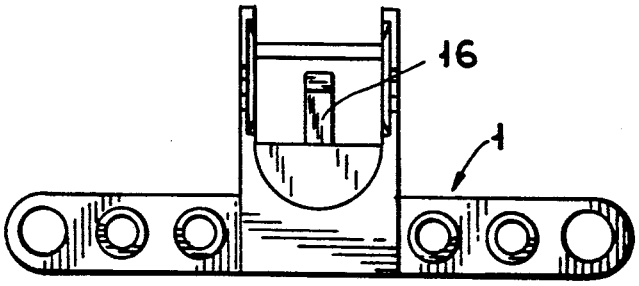

The invention will be described more fully below with reference to the drawing, in which FIG. 1 is a perspective view of a steering gear housing and a bushing means according to the invention adapted to be received by said housing, FIG. 2 is a perspective view of the components illustrated in FIG. 1 in connection with a steering rod according to the invention adapted to be positioned in the bushing means, FIG. 3 is a perspective view of the constituent parts of the steering mechanism, FIG. 4 is a perspective view of the mode of operation of the steering mechanism of the invention, FIG. 5 is a side view of the steering mechanism, from which the possible adjustments of the steering column inclination of the steering mechanism appear, and FIG. 6 is a top plan view of the steering gear housing.

FIG. 1 shows a steering gear housing 1 which substantially receives all the parts incorporated in the steering mechanism. It appears that the steering gear housing is contiguous with a beam 2 which is provided, in a manner known per se, with coupling studs and holes for coupling with other elements belonging to a toy building set. It will likewise be seen how a bushing means 5 is adapted to be received in the steering gear housing via edge projections on the end portions of the cylinder-shaped part, said portions engaging two holes 3 and 4 aligned on the steering gear housing.

FIG. 2 shows the location of the bushing means 5 in the steering gear housing. It is likewise indicated how a through channel 11 in the bushing means 5 is adapted to receive a rack means 6, whose ends are provided with steering rod means 13 having coupling means 14 at their extremities. In the embodiment shown here, these consist of a pair of pipe sections having mutually parallel axes extending transversely to the longitudinal axis of the rack means 6.

In FIG. 2, the rack means 6 is shown in its preferred embodiment, where the teeth extend all the way around its own axis, and where each of the control rods extending from each end forms an acute angle with the longitudinal axis of the rack means. This orientation of the steering rods 13 results in a very great flexibility for the coupling with other elements via the coupling means 14. In this connection, the toothed area of the rack means 6 extends, as mentioned, all the way round its own axis, thus increasing the flexibility in the attachment of the rack means 6 to other components.

In FIG. 3, the rack means 6 is shown in a position of use, it being indicated by arrows how a pinion 10 for cooperation with the rack is adapted for substantially loose mounting on the teeth 12. In connection with radial fixing of the pinion, the bushing means 5 is to this end provided with a pair of bracket means 7 and 8 having mutually aligned holes, and a shaft of X-crosssection or a steering column 9 is moved through the bracket holes as well as the pinion 10.

FIG. 4 shows the mode of operation of the steering mechanism, and it will be appreciated in this connection that the mechanism of the invention can be used in many positions as regards mounting of the steering rods 13, and it appears additionally with the shown, preferred toothing area that the pinion 10 can obtain the same tooth engagement with the rack means along its entire periphery so that, irrespective of the positioning of the rack means 6, the steering column 9 can assume various, desired included positions. The latter is shown more clearly in FIG. 5.

It also appears from the figures that the bushing means 5 is wholly or partly provided with a corrugation 15 on its cylindrical part. In this preferred embodiment, the bushing means is adapted to assume various slidably engaged positions via its axial movability, the corrugation 15 being adapted to cooperate with a flexible tongue means 16 (see FIG. 6) at the bottom of the steering gear housing.

It will likewise be appreciated that additional, other combinations are possible within the same or other building sets by changing the shape and position of the steering rod means 13 with respect to the rack means 12, just as it is possible to vary the construction of the coupling means 14 provided at the extremities of the steering rod means.

I claim:

1. A steering mechanism for toy building sets of the type comprising a rack means (6) and a pinion (10) adapted to cooperate with said rack means, characterized in that the tooth region of the rack means comprises a number of substantially arc-shaped teeth (12), each of said teeth comprising a disc extending perpendicular to and at least partly around the axis of the toothed region, said tooth region being integral with steering rods (13) which project from each end and are provided with coupling means (14), and in that the steering mechanism further includes a bushing means (5) with a substantially cylinder-shaped part having an opening therein (11) which is adapted to slidably receive the rack means, and that the pinion (10) is journalled in bracket means (7 and 8) which are secured to the cylinder-shaped part for cooperation with the rack means.

2. A steering mechanism according to claim 1, characterized in that each of the steering rods 13 projecting from the ends of the rack means forms an acute angle with the longitudinal axis of the rack means.

3. A steering mechanism according to claim 1, characterized in that the bushing means (5) is rotatably journalled in a steering gear housing (1).

4. A steering gear mechanism according to claim 3, characterized in that the bushing means (5) rotatably journalled in a steering gear housing (1) is provided wholly or partly with a corrugation (15) on its outer face disposed between the bracket means (7 and 8), said corrugation being adapted to slidable engagement with a flexible tongue means provided on the steering housing.

5. A steering mechanism according to claim 1, characterized in that the teeth (12) of the toothed region encompasses the rack means (6) entirely.

* * * * *